US007723603B2

(12) United States Patent
Moffatt

(10) Patent No.: US 7,723,603 B2
(45) Date of Patent: May 25, 2010

(54) METHOD AND APPARATUS FOR COMPOSING AND PERFORMING MUSIC

(75) Inventor: Daniel W. Moffatt, Edina, MN (US)

(73) Assignee: Fingersteps, Inc., Edina, MN (US)

( * ) Notice: Subject to any disclaimer, the term of this patent is extended or adjusted under 35 U.S.C. 154(b) by 0 days.

(21) Appl. No.: 11/554,388

(22) Filed: Oct. 30, 2006

(65) Prior Publication Data

US 2007/0107583 A1 May 17, 2007

Related U.S. Application Data

(63) Continuation-in-part of application No. 10/606,817, filed on Jun. 26, 2003, now Pat. No. 7,129,405, and a continuation-in-part of application No. 11/174,900, filed on Jul. 5, 2005.

(60) Provisional application No. 60/391,838, filed on Jun. 26, 2002, provisional application No. 60/585,617, filed on Jul. 6, 2004, provisional application No. 60/742,487, filed on Dec. 5, 2005, provisional application No. 60/853,688, filed on Oct. 24, 2006.

(51) Int. Cl.
*G10H 1/36* (2006.01)
*G10H 7/00* (2006.01)

(52) U.S. Cl. ..... 84/610; 84/609; 84/634; 84/645; 84/650; 84/666; 84/477 R

(58) Field of Classification Search ..... 84/600, 84/615–616, 622–625, 634, 645, 653–654, 84/659–660, 666, 477 R, DIG. 6
See application file for complete search history.

(56) References Cited

U.S. PATENT DOCUMENTS 4,527,456 A 7/1985 Perkins et al.
4,783,812 A 11/1988 Kaneoka
4,787,051 A 11/1988 Olson
4,852,443 A 8/1989 Duncan et al.
4,998,457 A 3/1991 Suzuki et al.
5,027,115 A 6/1991 Sato et al.
5,181,181 A 1/1993 Glynn
5,315,057 A 5/1994 Land et al.
5,442,168 A 8/1995 Gurner et al.
5,502,276 A 3/1996 Jameson
5,513,129 A 4/1996 Bolas et al.
5,533,903 A * 7/1996 Kennedy ..... 434/307 R
5,589,947 A 12/1996 Sato et al.
5,670,729 A 9/1997 Miller et al.

(Continued)

FOREIGN PATENT DOCUMENTS

WO WO 95/21436 8/1995

*Primary Examiner*—Marlon T Fletcher
(74) *Attorney, Agent, or Firm*—Nathan J. Witzany; Dorsey & Whitney LLP

(57) ABSTRACT

The present invention is method and apparatus for music performance and composition. More specifically, the present invention is an interactive music apparatus comprising actuating a signal that is transmitted to a processing computer that transmits output signals to a speaker that emits sound and an output component that performs an action. Further, the present invention is also a method of music performance and composition. Additionally, the present invention is an interactive wireless music apparatus comprising actuating an event originating on a remote wireless device. The transmitted event received by a processing host computer implements the proper handling of the event.

19 Claims, 16 Drawing Sheets

U.S. PATENT DOCUMENTS 5,691,898 A 11/1997 Rosenberg et al.
5,734,119 A 3/1998 France et al.
5,875,257 A 2/1999 Marrin et al.
5,973,254 A 10/1999 Yamamoto
5,977,471 A 11/1999 Rosenzweig
6,075,195 A 6/2000 Gabai et al.
6,096,961 A 8/2000 Bruti et al.
6,150,599 A 11/2000 Fay et al.
6,175,070 B1 1/2001 Naples et al.
6,222,522 B1 4/2001 Mathews et al.
6,232,541 B1 * 5/2001 Kumagai ..... 84/645
6,313,386 B1 11/2001 Capobianco et al.
6,429,366 B1 8/2002 Terada
6,462,264 B1 10/2002 Elam
6,743,164 B2 * 6/2004 Airaudi et al. ..... 600/27
6,867,965 B2 3/2005 Khoo
6,881,888 B2 4/2005 Akazawa et al.
7,045,698 B2 5/2006 Miyamoto
7,099,827 B1 8/2006 Tamura
7,126,051 B2 10/2006 Fay et al.
7,129,405 B2 10/2006 Moffatt et al.
7,319,185 B1 1/2008 Wieder
2001/0015123 A1 8/2001 Nishitani et al.
2001/0045154 A1 11/2001 Aoki
2002/0002898 A1 1/2002 Schmitz et al.
2002/0007720 A1 1/2002 Aoki et al.
2002/0044199 A1 4/2002 Barzebar et al.
2002/0056622 A1 5/2002 Yamashita et al.
2002/0112250 A1 8/2002 Koplar et al.
2002/0121181 A1 9/2002 Fay et al.
2002/0198010 A1 12/2002 Komsi et al.
2003/0037664 A1 * 2/2003 Comair et al. ..... 84/609
2004/0069119 A1 4/2004 Juszkiewicz
2004/0089142 A1 * 5/2004 Georges et al. ..... 84/610
2004/0137984 A1 * 7/2004 Salter ..... 463/35
2004/0139842 A1 7/2004 Brenner et al.
2004/0154461 A1 8/2004 Havukainen et al.
2004/0266491 A1 * 12/2004 Howard et al. ..... 455/567
2005/0071375 A1 * 3/2005 Houghton et al. ..... 707/104.1
2005/0172789 A1 8/2005 Hsu et al.
2005/0202385 A1 9/2005 Coward et al.
2006/0005692 A1 * 1/2006 Moffatt ..... 84/645
2006/0011042 A1 1/2006 Brenner et al.
2006/0034301 A1 * 2/2006 Anderson et al. ..... 370/401
2006/0036941 A1 2/2006 Neil
2006/0054006 A1 3/2006 Akazawa
2006/0239246 A1 10/2006 Cohen et al.
2006/0288842 A1 * 12/2006 Sitrick et al. ..... 84/477 R
2007/0087686 A1 4/2007 Holm et al.
2007/0124452 A1 5/2007 Mohammed
2007/0131098 A1 6/2007 Moffatt
2007/0157259 A1 7/2007 Koplar et al.
2007/0261535 A1 11/2007 Sherwani et al.
2008/0032723 A1 2/2008 Rosenberg
2008/0126294 A1 5/2008 Ray et al.
2009/0138600 A1 5/2009 Baum et al.

* cited by examiner

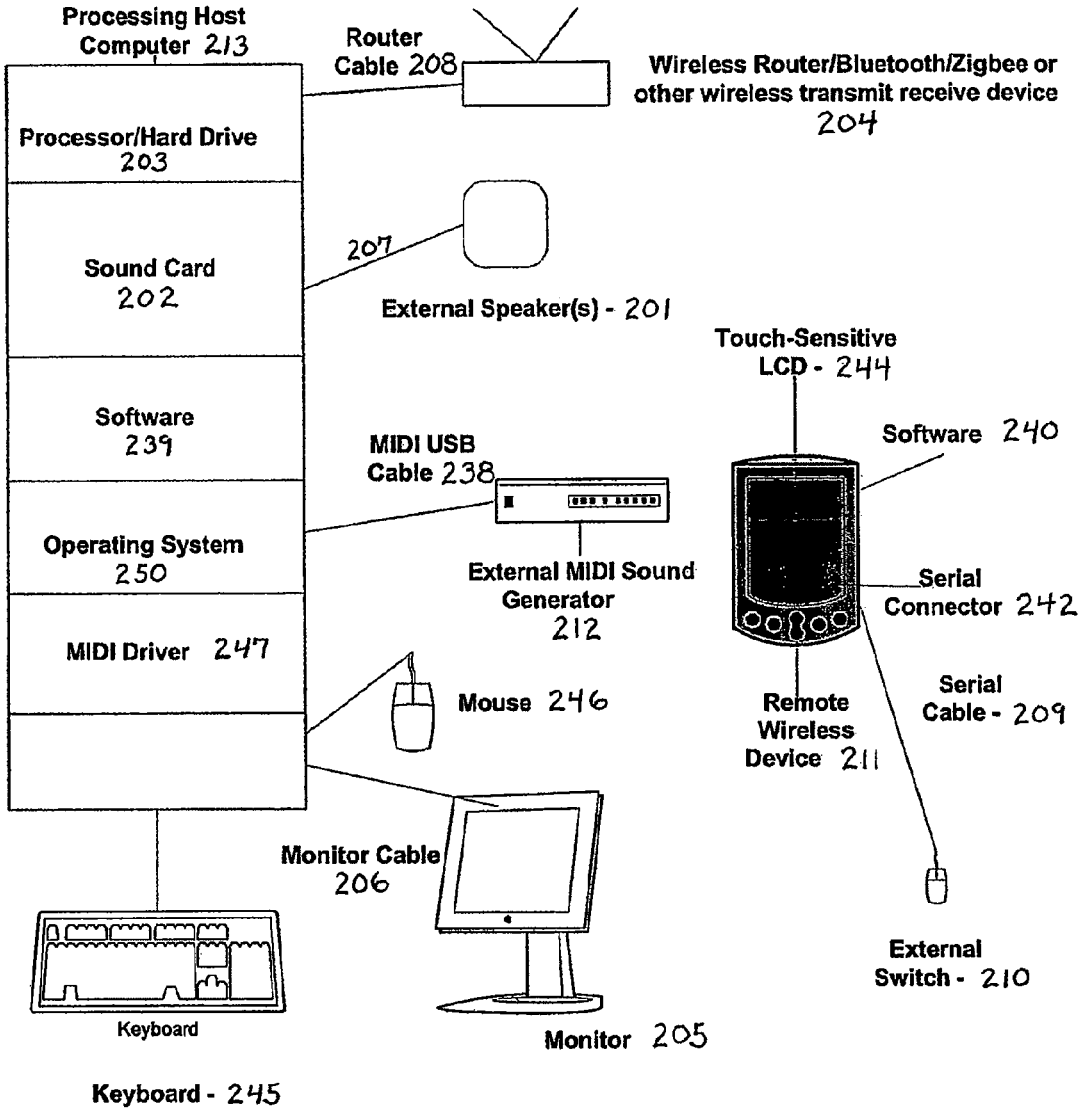
Fig. 1B- Schematic

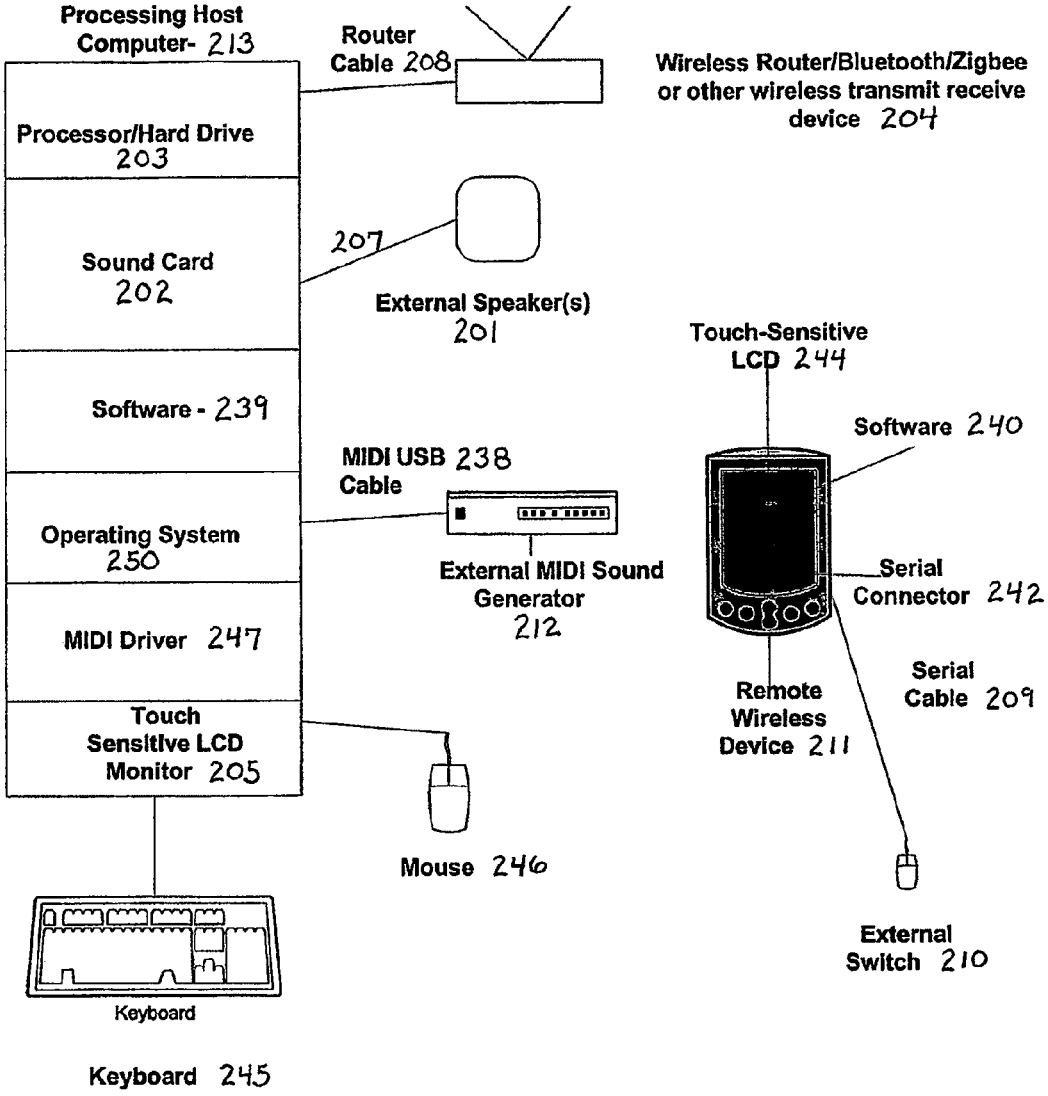
Fig. 1C - Alternative Schematic

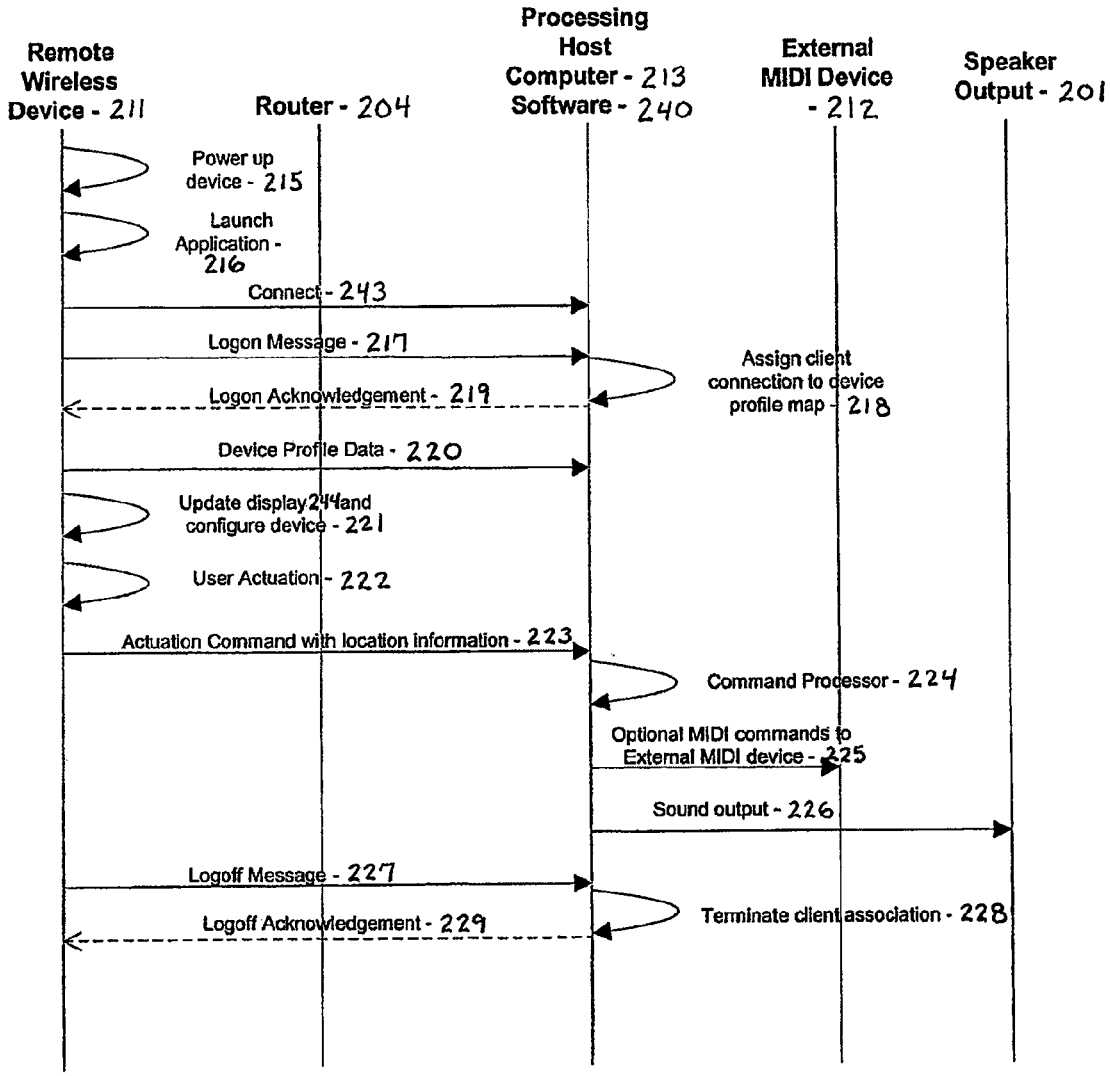
Fig. 6 Standard Operation Processing

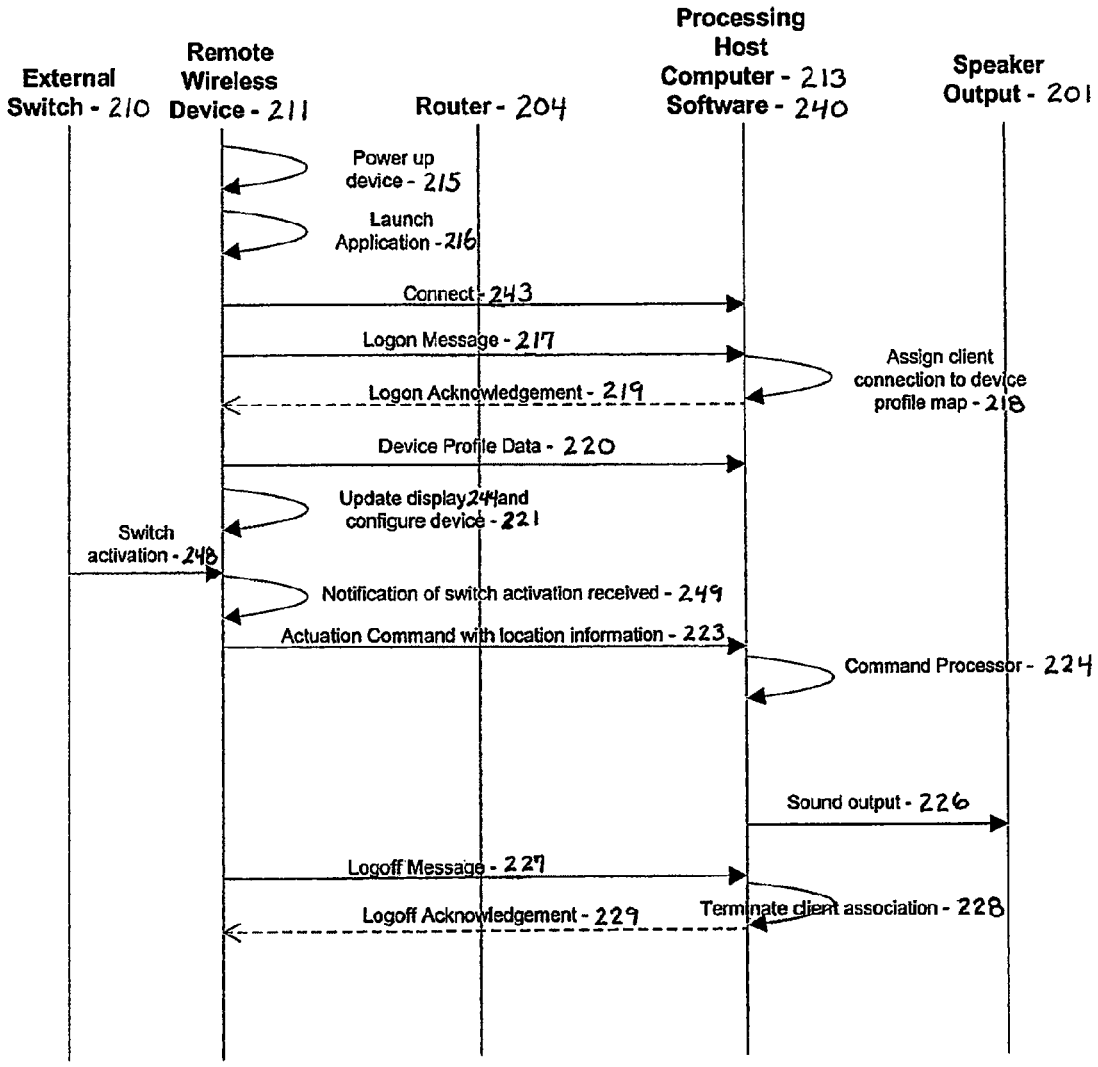
Fig. 6A Standard Operation Processing with External Switch

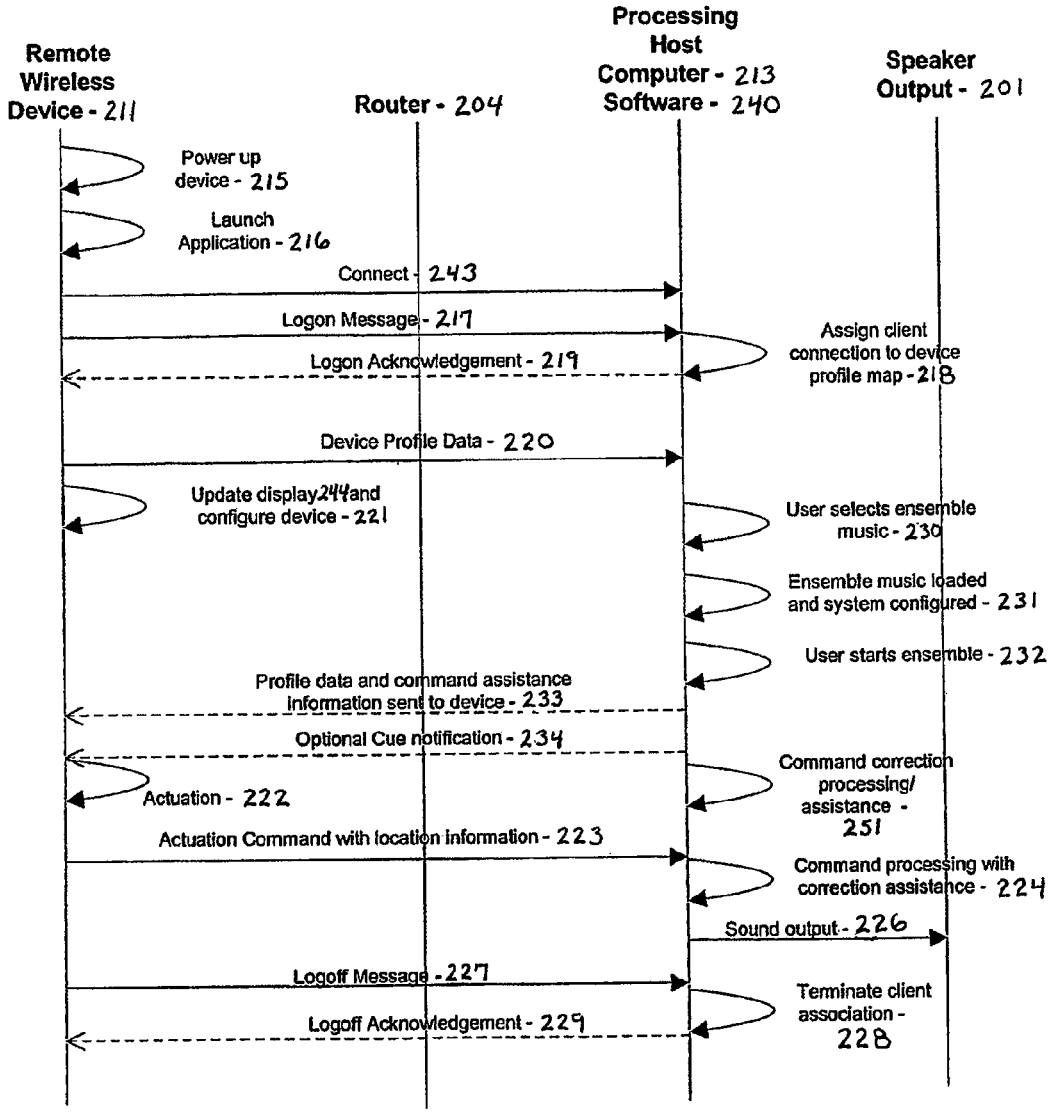
Fig. 7 Ensemble Operation Processing

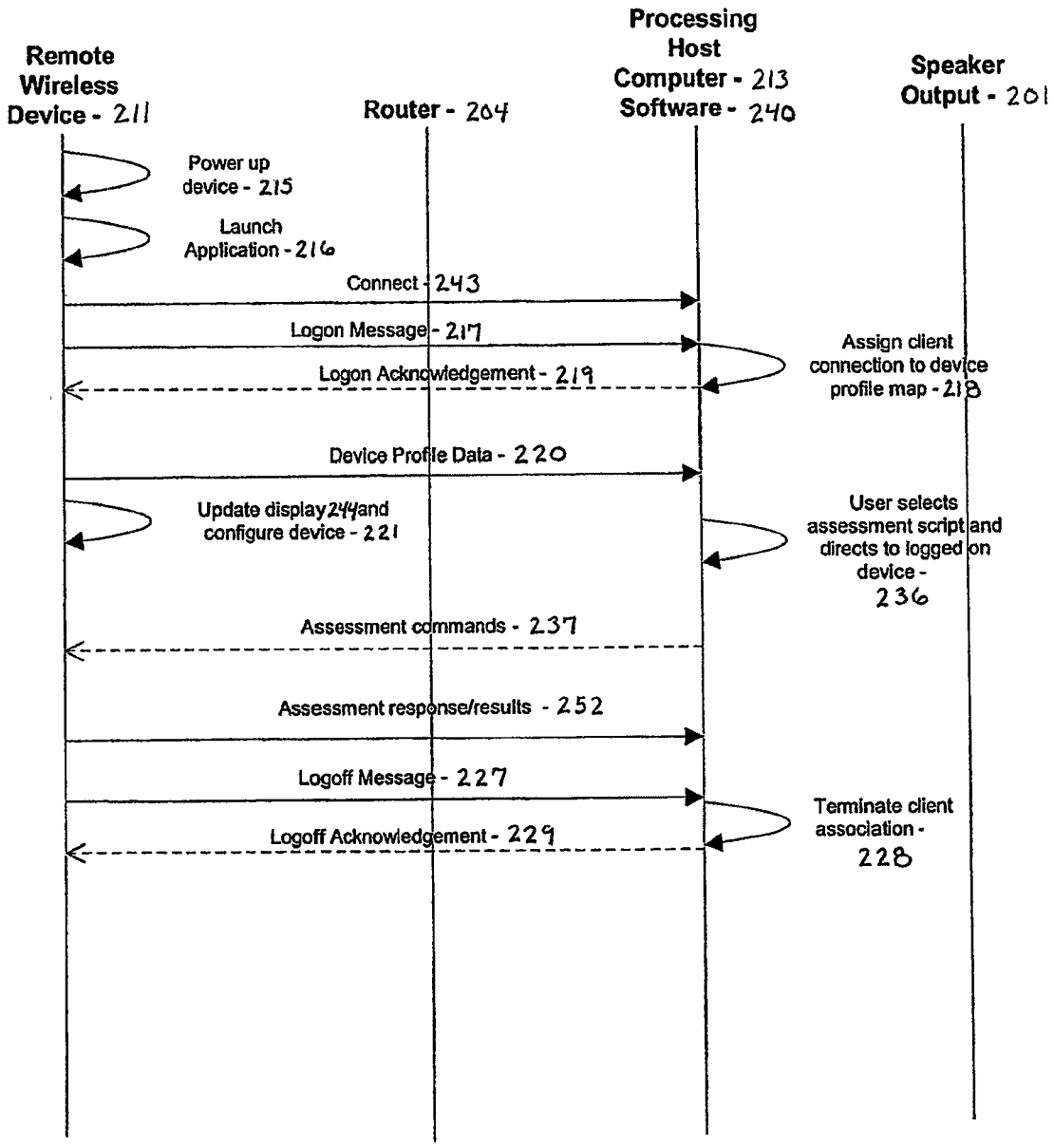
Fig. 8 Assessment Operation Processing

METHOD AND APPARATUS FOR COMPOSING AND PERFORMING MUSIC

CROSS-REFERENCE TO RELATED APPLICATION(S)

This application is a continuation in part application of U.S. patent application Ser. No. 10/606,817, filed on Jun. 26, 2003, now U.S. Pat. No. 7,129,405, which claims priority to U.S. Provisional Application No. 60/391,838, filed on Jun. 26, 2002, and further is a continuation in part of U.S. patent application Ser. No. 11/174,900, filed on Jul. 5, 2005, and published on Jan. 12, 2006, which claims priority to U.S. Provisional Application No. 60/585,617, filed on Jul. 6, 2004, and further claims priority to U.S. Provisional Application No. 60/742,487, filed on Dec. 5, 2005 and U.S. Provisional Application No. 60/853,688, filed on Oct. 24, 2006, the contents of all of which are incorporated by reference.

TECHNICAL FIELD

The present invention relates generally to the field of musical apparatus. More specifically, the present invention relates to a musical performance and composition apparatus incorporating a user interface that is adaptable for use by individuals with physical disabilities. Similarly, the present invention relates to a wireless electronic musical instrument, enabling musicians of all abilities to learn, perform, and create sound.

BACKGROUND OF THE INVENTION

For many years as is common today, performing music is restricted to traditional instruments such as acoustic and electronic keyboards, stringed, woodwind, percussive and brass. In all of the instruments in each of these classifications, a high level of mental aptitude and motor skill is required to adequately operate the instrument. Coordination is necessary to control breathing, fingering combinations, and expression. Moreover, the cognitive ability to read the music, watch the conductor for cues, and listen to the other musicians to make adjustments necessary for ensemble play require high cognitive function. Most school band programs are limited to the use of these instruments and limit band participation to only those students with the physical and mental capacity to operate traditional instruments.

For example, a student with normal mental and physical aptitude shows an interest in a particular traditional instrument, and the school and/or parents make an instrument available with options for instruction. The child practices and attends regular band rehearsals. Over time, the student becomes proficient at the instrument and playing with other musicians. This is a very common scenario for the average music student.

However, this program assumes all children have adequate cognitive and motor function to proficiently operate a traditional instrument. It assumes that all children are capable of reading music, performing complex fingering, controlling dynamics, and making necessary adjustments for ensemble performance. The currently available musical instruments do not consider individuals with below normal physical and mental abilities. Hence, it prohibits the participation of these individuals.

Teaching music performance and composition to individuals with physical and mental disabilities requires special adaptive equipment. Currently, these individuals have limited opportunities to learn to perform and compose their own music because of the unavailability of musical equipment that is adaptable for their use. Teaching music composition and performance to individuals with physical and mental disabilities requires instruments and teaching tools that are designed to compensate for disabled students' limited physical and cognitive abilities.

For example, students with physical and mental disabilities such as cerebral palsy often have extremely limited manual dexterity and thus are unable to play the typical keyboard instrument with a relatively large number of narrow keys. Similarly, a user with physical disabilities may have great difficulty grasping and manipulating drumsticks and thus would be unable to play the typical percussion device. Also, disabled users are unable to accurately control the movements of their hands, which, combined with an extremely limited range of motion, can also substantially limit their ability to play keyboard, percussion, or other instruments. Such users may, however, exhibit greater motor control using their head or legs.

Furthermore, the currently available musical instruments are generally inflexible in regard to the configurations of their user interfaces. For example, keyboards typically have a fixed number that cannot be modified to adapt to the varying physical capabilities of different users. In addition, individuals with cognitive delays are easily distracted and can lose focus when presented with an overwhelming number of keys. Similarly, teaching individuals with mental and physical disabilities basic music theory requires a music tutorial device that has sufficient flexibility to adjust for a range of different cognitive abilities.

Consequently, there is a need in the art for a music performance and composition apparatus with a user interface adaptable for use by individuals with physical and mental disabilities, such that these individuals can perform and compose music with minimal involvement by others. In addition, there is a need for an apparatus allowing disabled users to use the greater motor control available in their head or legs. Furthermore, there is a need in the art for a music composition and performance tutorial system incorporating this new apparatus that allows musicians with disabilities to learn to compose and perform their own music.

Similarly, there is a need in the art for a universal adaptive musical instrument that enables people of all abilities to perform music alone, with other individuals of similar abilities, or with others in a traditional band setting. This solution could provide the necessary flexibility to assist individuals with their particular disability.

BRIEF SUMMARY OF THE INVENTION

The present invention, in one embodiment, is an interactive music apparatus. The apparatus has at least one actuator, a voltage converter, a processing computer, a speaker, and an output component. The actuator is configured to transmit a signal upon actuation and the voltage converter is configured to convert the signal from the actuator into a data stream. The processing computer is configured to convert the data stream into a first output signal and a second output signal. The speaker is configured to receive the first output signal and emit sound. The output component is configured to receive the second output signal and perform an action based on the second output signal.

According to a further embodiment, the present invention is a method of music performance and composition. The method includes actuating transmission of a signal, converting the signal into a data stream, converting the data stream at a processing computer into a first output signal and a second output signal, emitting sound at a speaker based on the first output signal, and performing an action at an output component based on the second output signal.

The present invention, in another embodiment, is a universal adaptive musical system. The system includes a host computing device, one or more remote wireless computing devices (actuator), a speaker configuration/output component and a wireless router. The actuator is configured to transmit a signal upon actuation and the voltage converter is configured to convert the signal from the actuator into a data stream. The processing computer is configured to convert the data stream into a first output signal and a second output signal. The speaker is configured to receive the first output signal and emit sound. The output component is configured to receive the second output signal and perform an action based on the second output signal.

According to yet a further embodiment, the present invention is a method of music performance. The method includes the wireless transmission of events on a remote wireless device. The data transferred over a wireless network is processed by the processing host computer which creates the output.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

FIG. 1B is a schematic diagram of another embodiment of the present invention.

FIG. 1C is a schematic diagram of yet another embodiment of the present invention.

FIG. 6 is a sequence diagram showing standard operation of the apparatus, according to an embodiment of the present invention.

FIG. 7 is a sequence diagram showing operation during ensemble mode of the apparatus, according to one embodiment of the present invention.

FIG. 8 is a sequence diagram depicting the operational flow during assessment mode using the apparatus, according to one embodiment of the present invention.

DETAILED DESCRIPTION

Figure 1:
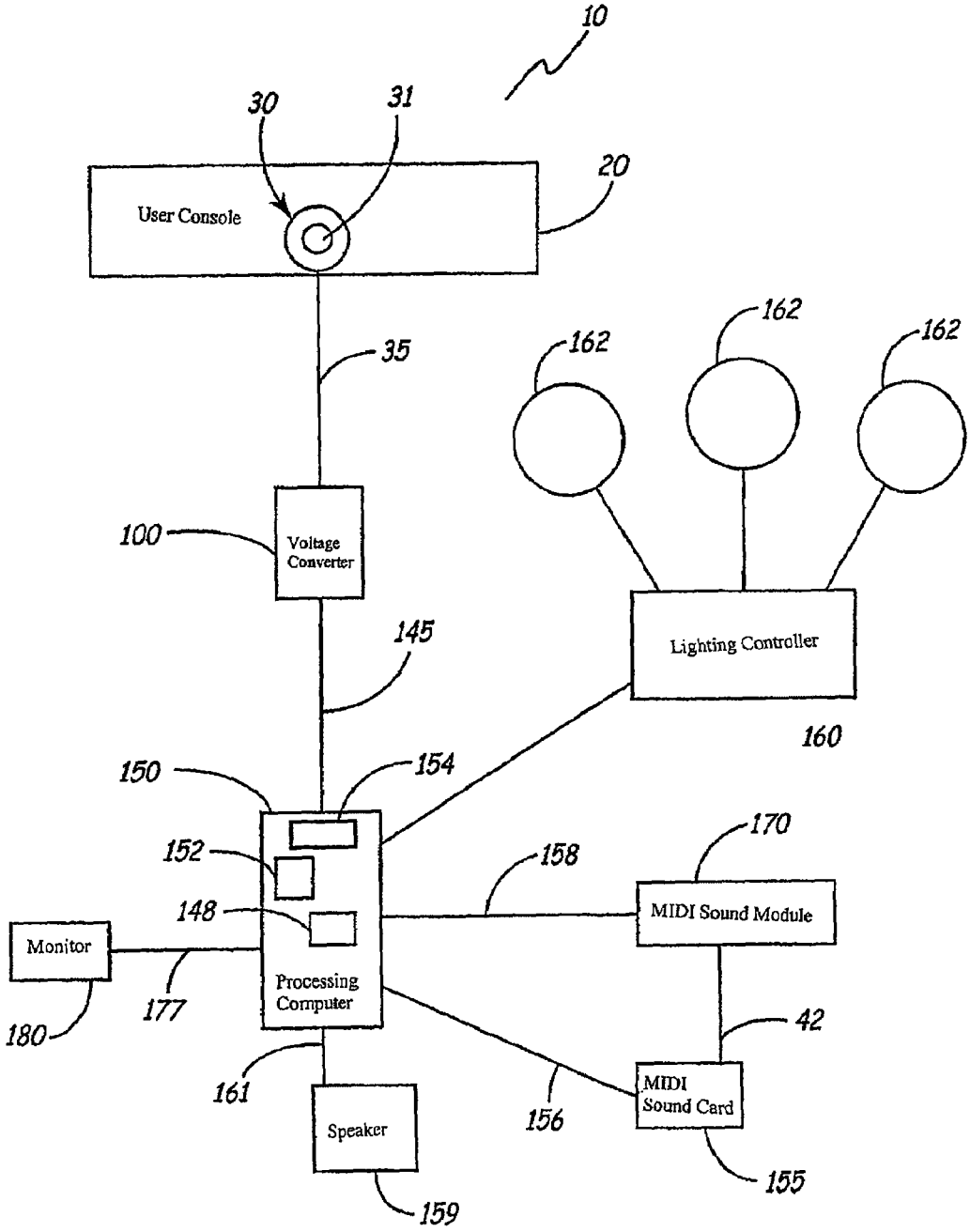
FIG. 1 is a schematic diagram of one embodiment of the present invention.

FIG. 1 shows a schematic diagram a music apparatus 10, according to one embodiment of the present invention. As shown in FIG. 1, the music apparatus 10 may include a user console 20 having at least one actuator 30 with an actuator button 31, a voltage converter 100, a processing computer 150 having a processor 154, software 152, and an internal sound card 148, a display monitor 180, and a speaker 159. In a further embodiment, the voltage converter 100 is an integral component of the user console 20. The actuator 30 is connected to the voltage converter 100 with an actuator cable 35. The voltage converter is connected to the processing computer 150 with a serial cable 145. The processing computer 150 is connected to the display monitor 180 by a monitor cable 177. The processing computer 150 is connected to the speaker 159 by a speaker line out cable 161.

In an alternative aspect of the present invention, the apparatus also has an external MIDI sound card 155 and a MIDI sound module 170. According to this embodiment, the processing computer 150 is connected to the external MIDI sound card 155 by a USB cable 156. The MIDI sound card 155 is connected to the MIDI sound module 170 via a MIDI cable 42. The MIDI sound module 170 is connected to the internal sound card 148 via an audio cable 158.

In a further alternative embodiment, the apparatus has a lighting controller 160 controlling a set of lights 162. The lighting controller 160 is connected to the processing computer 150. The lighting controller 160 is also connected to each light of the set of lights 162. The lighting controller 160 can be any known apparatus for controlling a light or lighting systems. The set of lights 162 can be one light. Alternatively, the set of lights 162 can be comprised of any number of lights.

In one embodiment, the actuator 30 may be any known mechanical contact switch that is easy for a user with disabilities to operate. Alternatively, different types of actuators, for example, light sensors, may also be used. In one aspect of the present invention, the number of actuators 30 can vary according to factors such as the user's skill level and physical capabilities. While FIG. 1 shows an embodiment having a single actuator 30 on the user console 20, further embodiments may have a plurality of actuators 30.

According to one embodiment, the processing computer 150 may be any standard computer, including a personal computer running a standard Windows® based operating system, with standard attachments and components (e.g., a CPU, hard drive, disk and CD-ROM drives, a keyboard and a mouse). The processor 154 may be any standard processor such as a Pentium® processor or equivalent.

Figure 1A:
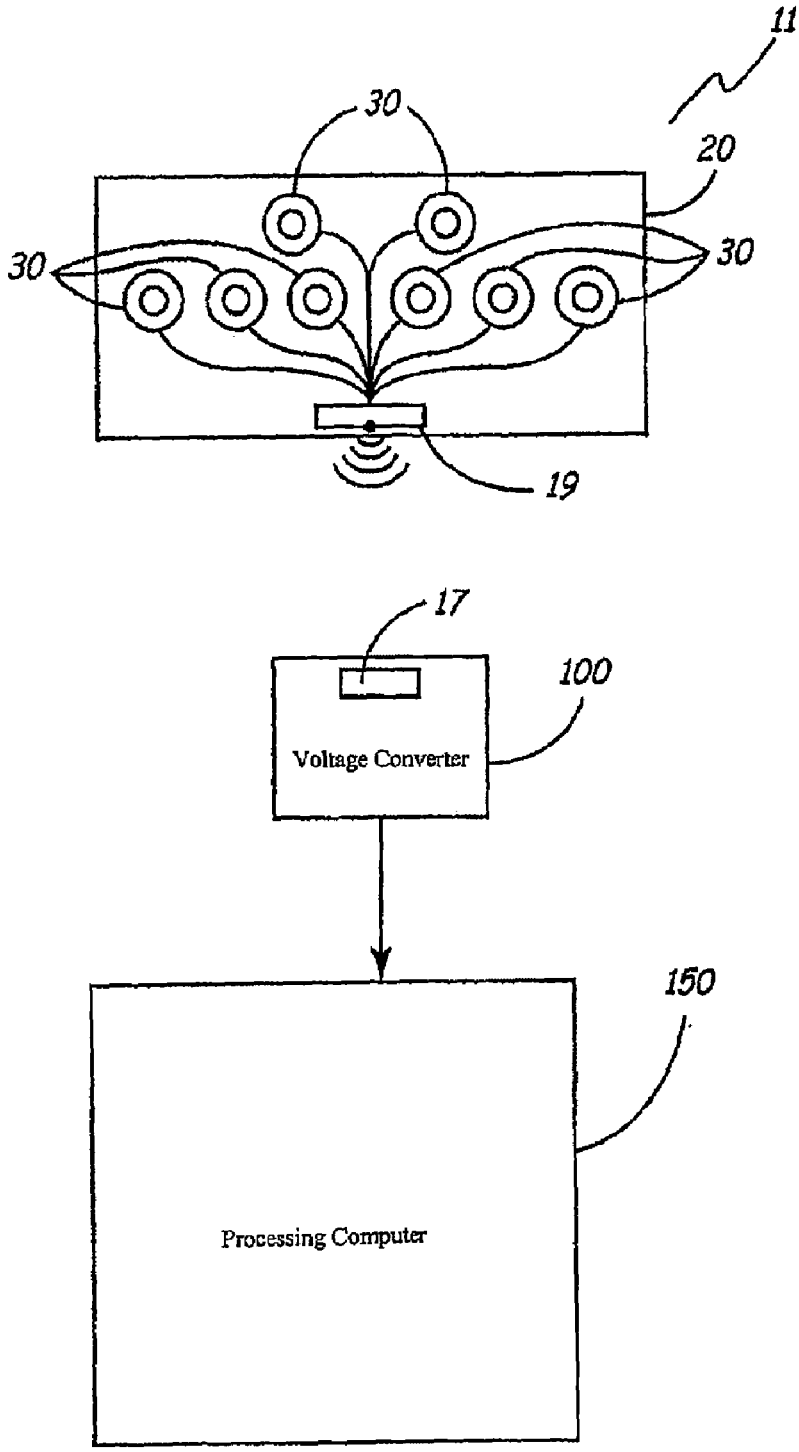
FIG. 1A is a schematic diagram of an alternative embodiment of the present invention.

FIG. 1A depicts a schematic diagram of a music apparatus 11, according to an alternative embodiment of the present invention. The apparatus 11 has a user console 20 with eight actuators 30 and a wireless transmitter 19, a converter 100 with a wireless receiver 17, and a processing computer 150. The actuators 30 are connected to the wireless transmitter 19 with actuator cables 31. In place of the electrical connection between the actuator 30 and the voltage converter 100 according to the embodiment depicted in FIG. 1, the wireless transmitter 19 shown in FIG. 1A can transmit wireless signals, which the wireless receiver 17 can receive.

Figure 2:
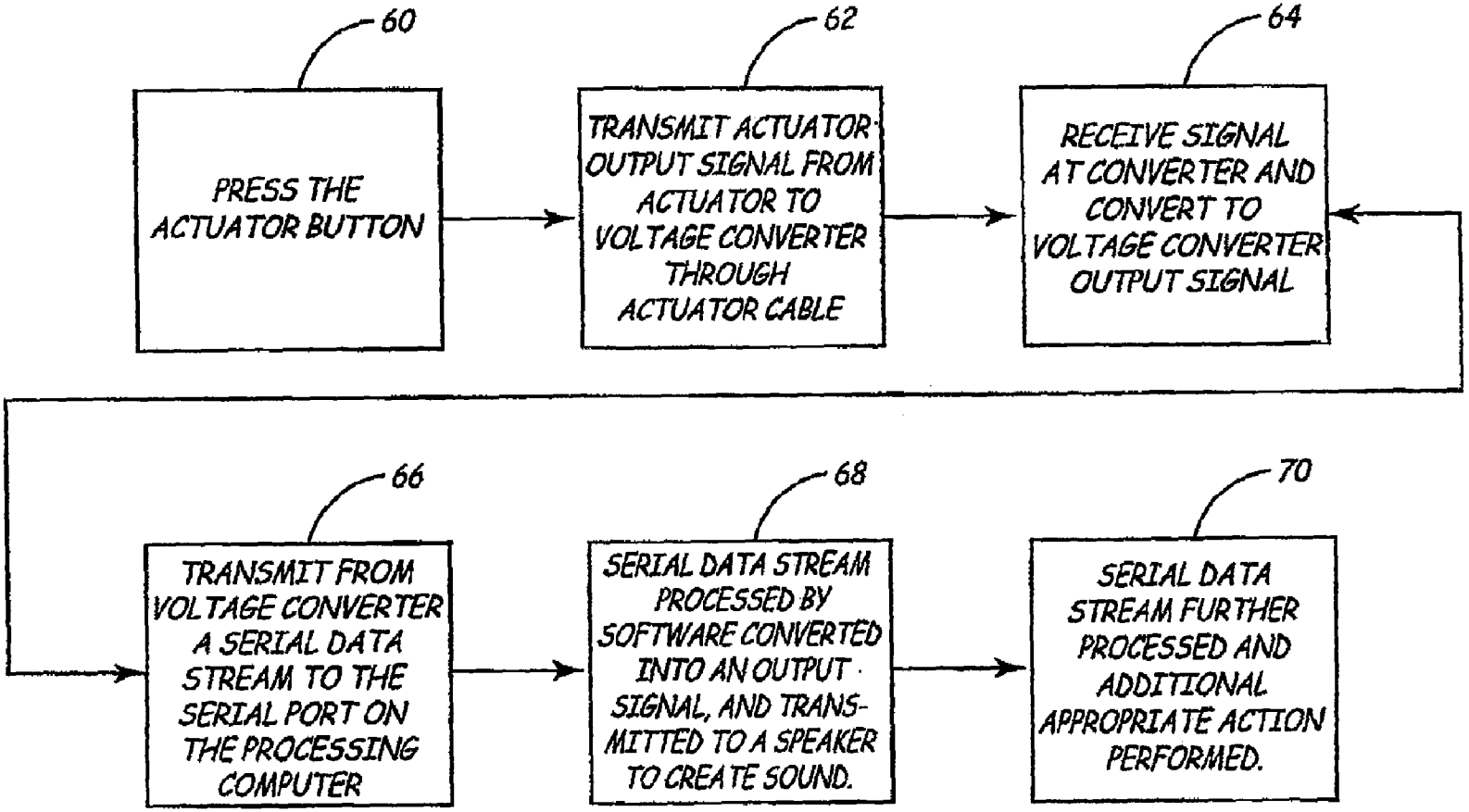
FIG. 2 is a flow chart showing the operation of the apparatus, according to one embodiment of the present invention.

FIG. 2 is a flow diagram showing the operation of the apparatus 10, according to one embodiment of the present invention. The user initiates operation by pressing the actuator button 31 (block 60). Upon engagement by the user, the actuator 30 transmits an actuator output signal to a voltage converter 100 through the actuator cable 35 (block 62). Alternatively, the actuator 30 transmits the output signal to the wireless transmitter 19, which transmits the wireless signal to the wireless receiver 17 at the voltage converter. The voltage converter 100 receives the actuator output signal 36 and converts the actuator output signal 36 to a voltage converter output signal 146 (block 64). The voltage converter output signal 146 is in the form of a serial data stream which is transmitted to the processing computer 150 through a serial cable 145 (block 66). At the processing computer 150, the serial data stream is processed by the software 152 and transmitted as an output signal to the speaker 159 to create sound (block 68). In accordance with one aspect of the invention, the serial data contains further information that is further processed and additional appropriate action is performed (block 70). That is, the additional action message information contained in the data stream is read by the software 152, which then initiates additional action. According to one embodiment, the additional information is merely repeated actuator address and actuator state information based on repeated actuations of the actuator 30 by the user. The software 152 defines and maps one or more actions to be executed by the hardware and/or software upon receiving the information. For purposes of this application, the information received by the hardware and/or software will be referred to as an output signal. According to one embodiment, the information is a command.

According to one embodiment, the step of processing the serial data stream, converting it into an output signal, and transmitting the signal to a speaker 159 to create sound (block 68) involves the use of a known communication standard called a musical instrument digital interface ("MIDI"). According to one embodiment, the software 152 contains a library of preset MIDI commands and maps serial data received from the voltage converter output signal 146 to one or more of the preset commands. As is understood in the art, each MIDI command is sent to the MIDI driver (not shown) of the processing computer 150. The MIDI driver directs the sound to the internal sound card 148 for output to the speaker 159.

Alternatively, the MIDI command is transmitted by the MIDI sound card from the processing computer 150 to the MIDI sound module 170. The MIDI sound module may be any commercially-available MIDI sound module containing a library of audio tones. The MIDI sound module 170 generates a MIDI sound output signal which is transmitted to the processing computer 150. A signal is then transmitted to the speaker 159 to create the predetermined sound.

FIG. 1B shows a schematic diagram a music apparatus according to one embodiment of the present invention. As shown in FIG. 1B, the music apparatus may include optional external speakers 201, an external wireless transmitter 204, and external MIDI sound generator 212, a processing computer 213 having a processor 203, software 239, an internal/external sound card 202, and a display monitor 205. The processing computer 213 is connected to the display monitor 205 by a monitor cable 206. The processing computer 213 is connected to the speaker 201 by a speaker line out cable 207. The wireless transmitter 204 is connected to the processing computer 213 via a cable 208. Likewise, the optional external MIDI device 212 is connected to the processing computer 213 via a MIDI cable 238. A remote wireless device 211 contains a processor, touch-sensitive LCD display 244, and software 240. In an alternative embodiment of this remote wireless device 211, a serial connector 242, serial cable 209, and actuator switch 210 are optional.

FIG. 1C presents an alternative aspect of the present invention. The processing computer 213 contains a touch-sensitive LCD 205, thus eliminating the monitor display cable 6.

In one embodiment, as stated above, the actuator 210 may be any known mechanical contact switch that is easy for a user to operate. Alternatively, different types of actuators, for example, light sensors, may also be used. In one aspect of the present invention, the number of actuators 10 can vary according to factors such as the user's skill, physical capabilities and actuator implementation.

According to one embodiment, as stated above, the processing computer 213 may be any standard computer, including a personal computer running a standard Windows® based operating system, with standard attachments and components (e.g., a CPU, hard drive, disk and CD-ROM drives, a keyboard and a mouse). The processor 203 may be any standard processor such as a Pentium® processor or equivalent.

FIG. 6 depicts a sequence diagram of standard operational flow for one embodiment of the present disclosure. The remote wireless device 211 is switched on. The remote wireless device software 240 is started and establishes a wireless connection 243 with the host processing PC 213 via the wireless transmitter (router) 204. Upon successful connection, the remote wireless device transmits a user log on or handshake message 217 to the host PC 213. The host PC 213 returns an acknowledgement message 219. Upon successful log on, the remote wireless device 211 notifies the host PC 213 of it's current device profile 220. The device profile 220 contains data necessary for the host PC 213 to properly service future commands 223 received from the remote device 211. Specifically, during host PC synchronization, a map of host PC 213 actions that correspond to specific remote device 211 x-y coordinates locations (or regions of x-y coordinates) on the remote device 211 LCD display 244 are created. With the mapping complete, both the host PC 213 and remote wireless device 211 are now synchronized. After successful synchronization, the host PC 213 and the remote wireless device 211 refresh their displays 205, 244 respectively. The user may press the LCD display 244 to send a command 223 to the host PC 213. A remote device command 223 transmitted to the host PC 213 contains an identifier to the location the user pressed on the remote device LCD 244. A remote device command 223 may optionally include meta data such as position change or pressure intensity. When the command 23 is received by the host PC 213, the host PC 213 invokes the command processor 224 which executes the action mapped to the location identifier. This action, handled in the command processor 224 may include directing a MIDI command or series of commands to the host PC 213 MIDI output, sending a MIDI command or series of commands to an external MIDI sound generator 212, playing a media file, or instructing the host PC 213 to change a configuration setting. It may also include a script that combines several disparate functions. The command processor 224 continues to service command messages until the remote device 211 logs off 227. Upon transmission and receipt by the host PC 213 of a log off message 227 of a remote device 211, the host PC 213 discontinues processing commands and destroys the action map.

FIG. 6A is a sequence diagram showing an alternative flow when an external switch, or actuator 210 is the source of the activation. The external switch actuator is connected to the remote wireless device 211 via serial communication cable 209. The user initiates operation by pressing the actuator button 210. Upon engagement by the user 248, the actuator 210 changes a pin condition on the serial connection 209. This event is recognized by the remote wireless device software 240. The remote device software 240 references a map that indicates the location identifier 249 to be transmitted to the host PC 213. The remote device 211 transmits the location identifier to the host PC 213.

According to one embodiment of this invention, the host PC 213 supports a multiple number of remote wireless devices 211 restricted only by the underlying limitations of the hardware and operating system (wireless transmitter 204, processor 203).

According to one embodiment, as stated above, the command processing of MIDI data involves the use of a known communication music computing standard called a Musical Instrument Digital Interface ("MIDI"). According to one embodiment, the operating system 250 provides a library of preset MIDI sounds. As is understood in the art, each MIDI command is sent to the MIDI driver (not shown part of the operating system 250) of the host PC 213. The MIDI driver directs the sound to the sound card 202 for output to the speaker 201.

Alternatively, the MIDI command is redirected by the MIDI driver to an external MIDI sound module 212. The MIDI sound module may be any commercially-available MIDI sound module containing a library of audio tones. The MIDI sound module 212 generates a MIDI sound output signal which may be directed to the speakers 201.

FIG. 7 is a sequence operational diagram depicting system operation in ensemble mode. In ensemble mode, the host PC 213 manages a real-time performance of one or more users. The music performed is defined in an external data file using the standard MIDI file format. The remote device 211 start up and log on sequence is identical to the sequence illustrated in FIG. 6. The change to ensemble mode takes place on the host PC 213. A system administrator selects a MIDI file to perform 230. The host PC 213 opens the MIDI file and reads in the data 231. The MIDI file contains all of the information necessary to playback a piece of music. This operation 231 determines the number of needed performers and assigns music to each performer. Performers may be live (a logged on performer) or a substitute performer (computer). The music assigned to live performers considers the performers ability and assistance needs (assessment profile). The system administrator selects the tempo for the performance and starts the ensemble processing 235. The host PC 213 and the remote wireless device 211 communicate during ensemble processing and offer functionality to enhance the performance of individuals that require assistance with the assigned part. These enhancements include visual cueing 234, command filtering, command location correction, command assistance, and command quantization 251. Visual cueing creates a visual cue on the remote device LCD 244 alerting the performer as to when and where to press the remote device LCD 244. In one embodiment, the visual cue may be a reversal of the foreground and background colors of a particular region of the remote device LCD 244. The visual cueing assists performers that have difficulty reading or hearing music. Using the MIDI file as a reference for the real-time performance, the command sequence expectation is known by the host PC 213 managing the performance. This enables the ensemble manager to provide features to enhance the performance. The command filter ignores out of sequence commands or commands that are not relevant at the time received within the performance. Command location correction adjusts the location identifier when the performer errantly presses the remote device LCD 244 at the incorrect x-y coordinate or region. Command assistance automatically creates commands for performers that do not respond within a timeout window. Command quantization corrects the timing of the received command in context to the performance.

FIG. 8 is a sequence operational diagram depicting system operation in assessment mode. In assessment mode, the host PC 213 manages series of assessment scripts to determine the performers cognitive and physical abilities. This evaluation enhances ensemble assignment and processing to optimize real-time ensemble performance. The remote device 211 start up and log on sequence is identical to the sequence illustrated in FIG. 6. The change to assessment mode takes place on the host PC 213. A system administrator selects an assessment script 236 and directs the assessment test to a particular remote device 211. The user responds 252 to his/her ability. The script may contain routines to record response time, location accuracy (motor skill) and memory recall (cognitive) using sequence patterns.

In one embodiment of the invention, several default device templates are defined. These templates define quadrilateral regions within the remote device LCD display 244. Each defined region has an identifier used in remote device 211 commands to the host PC 213. The command processor on the host PC 213 determines the location on the remote device LCD 244 using this template region identifier.

In one embodiment of the invention, a region may be designated as a free form location. A remote device region with this free form attribute includes additional information with the commands transmitted to the host PC 213. This meta data includes relative movement on the remote device LCD 244. The change in x and y coordinate values is included with the location identifier. Coordinate delta changes enable the command processor to extend the output of the command to include changes in dynamics, traverse a scale or series of notes, modify sustained notes or process and series of MIDI commands.

In one embodiment of the invention, ensemble configurations may be defined on the host PC 213. Ensemble configurations are pre-defined remote device configuration sets which detail regions definitions for known remote devices 211. These ensemble configuration sets may be downloaded to the remote devices 211 via the host PC 213 simultaneously.

In one embodiment of the invention, the mechanism of data transmission between the remote wireless device 211 and the host PC 213 may be TCP/IP, Bluetooth, 802.15, or other wireless technology.

Figure 2A:
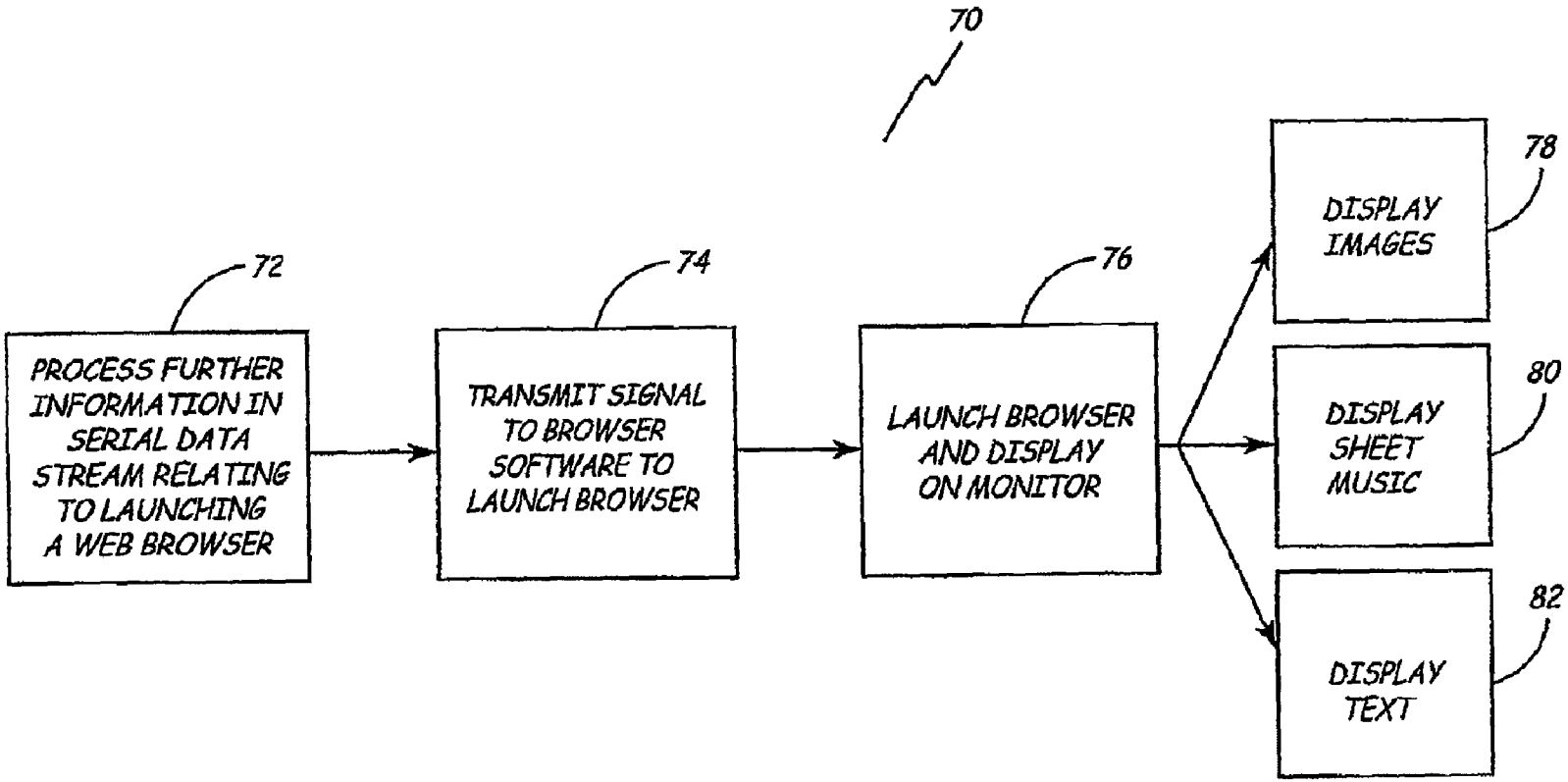
FIG. 2A is a flow chart depicting the process of launching a web browser using the apparatus, according to one embodiment of the present invention.

FIG. 2A is a flow chart depicting the activation of the additional action of launching a web browser, according to one embodiment. The software 152, 239 processes the further information in the serial data stream relating to launching a web browser (block 72). A signal is then transmitted to the browser software 152, 239 indicating that the browser should be launched (block 74). The browser is launched and displayed on the monitor 180, 205 (block 76). According to one embodiment, the browser then displays images as required by the data stream (block 78). For example, photographs or pictures relating a story may be displayed. Alternatively, the browser displays sheet music coinciding with the music being played by the speaker 159, 201 (block 80). In a further alternative, the browser displays text (block 82). The browser may display any known graphics, text, or other browser-related images that may relate to the notes being played by the speaker 159, 201. In an alternative aspect of the present invention, the browser is an embedded control within the software 152, 239 of the processing computer 150, 213.

Figure 2B:
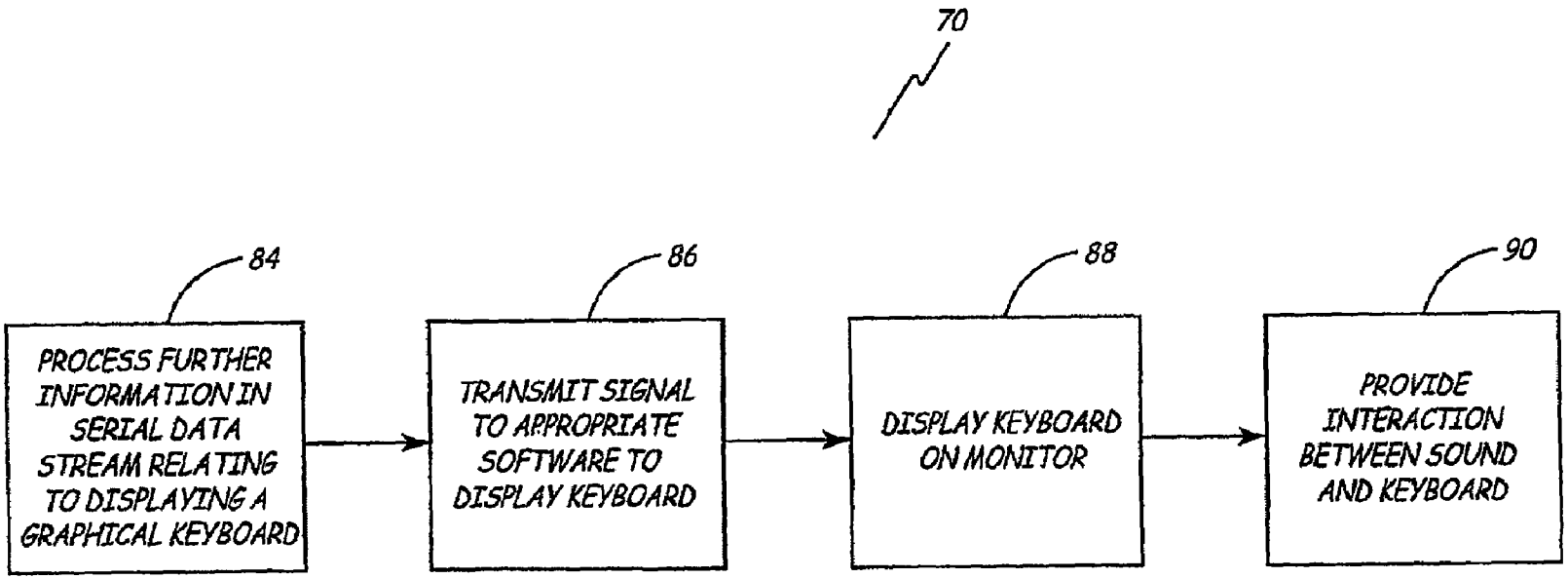
FIG. 2B is a flow chart depicting the process of displaying a graphical keyboard using the apparatus, according to one embodiment of the present invention.

FIG. 2B is a flow chart depicting the activation of the additional action of displaying a graphical keyboard, according to one embodiment. The software 152, 239 processes the further information in the serial data stream relating to displaying a graphical keyboard (block 84). A signal is then transmitted to the appropriate software 152, 239 indicating that the keyboard should be displayed (block 86). The keyboard is displayed on the monitor 180, 205 (block 88). According to one embodiment, interaction is then provided between the sounds emitted by the speaker 159, 201 and the keyboard (block 90). According to one embodiment, the interaction involves the highlighting or otherwise indicating the appropriate key on the keyboard for the note currently being emitted by the speaker 159, 201. Alternatively, any known interaction between the sound and the keyboard is displayed.

Figure 2C:
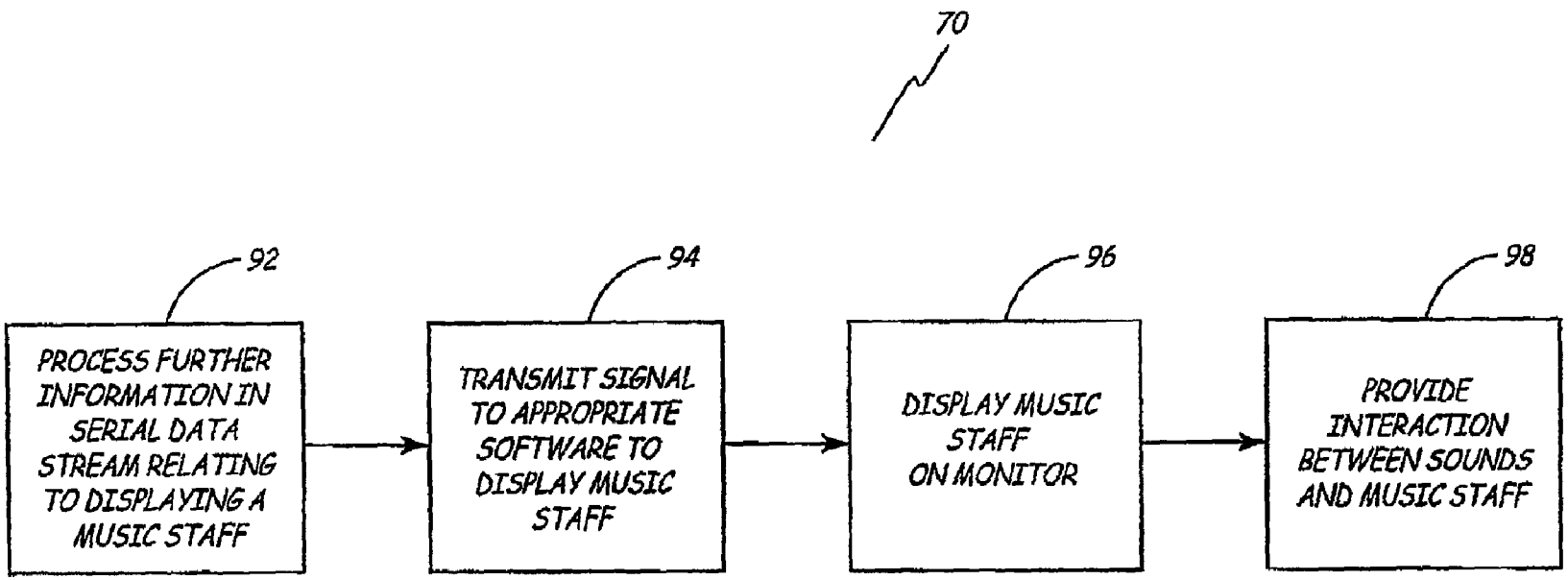
FIG. 2C is a flow chart depicting the process of displaying a music staff using the apparatus, according to one embodiment of the present invention.

FIG. 2C is a flow chart depicting the activation of the additional required action of displaying a music staff, according to one embodiment. The software 152, 239 processes the further information in the serial data stream relating to displaying a music staff (block 92). A signal is then transmitted to the appropriate software 152, 239 indicating that the music staff should be displayed (block 94). The music staff is displayed on the monitor 180, 205 (block 96). According to one embodiment, interaction is then provided between the sounds emitted by the speaker 159, 201 and the music staff (block 98). According to one embodiment, the interaction involves the displaying the appropriate note in the appropriate place on the music staff corresponding to the note currently being emitted by the speaker 159, 201. Alternatively, any known interaction between the sound and the music staff is displayed.

Figure 2D:
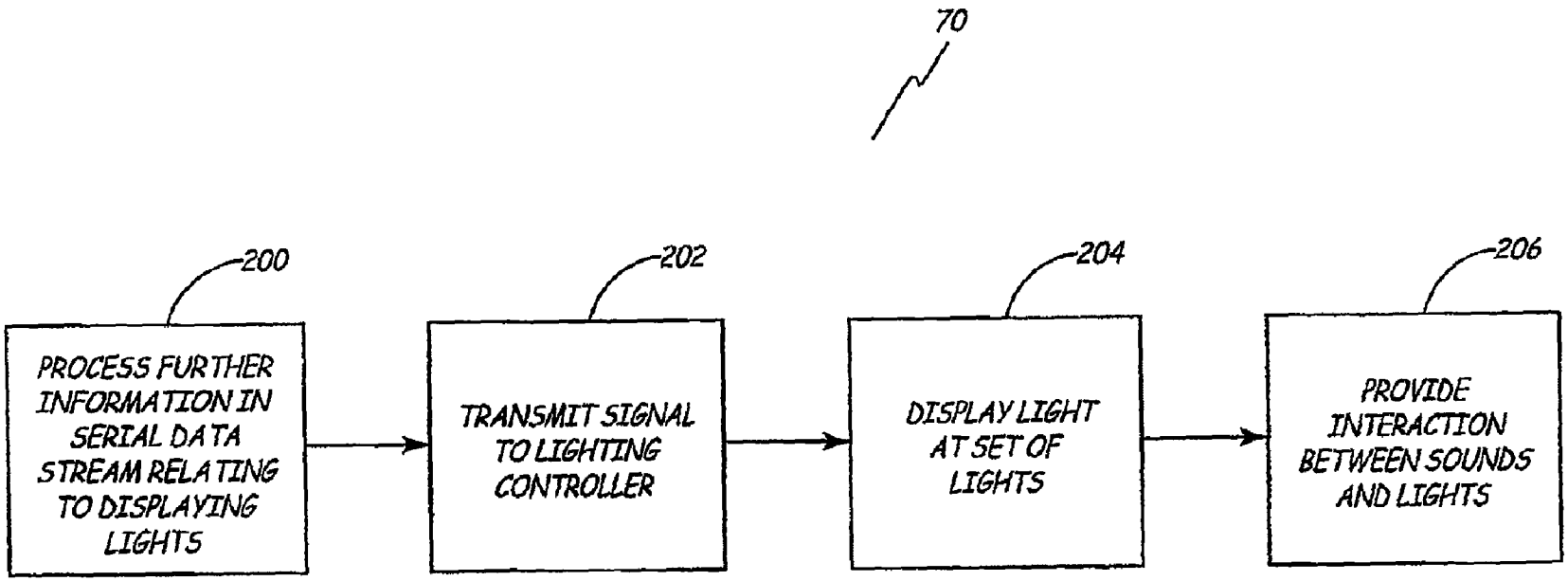
FIG. 2D is a flow chart depicting the process of providing a display of light using the apparatus, according to one embodiment of the present invention.

FIG. 2D is a flow chart depicting the activation of the additional action of displaying lights, according to one embodiment. The software 152, 239 processes the further information in the serial data stream relating to displaying lights (block 200). A signal is then transmitted to the lighting controller 160 indicating that certain lights should be displayed (block 202). Light is displayed at the set of lights 162 (block 204). According to one embodiment, interaction is then provided between the sounds emitted by the speaker 159, 201 and the lights (block 206). According to one embodiment, the interaction involves the flashing a light for each note emitted by the speaker 159, 201. Alternatively, any known interaction between the sound and the lights is displayed.

Figure 3:
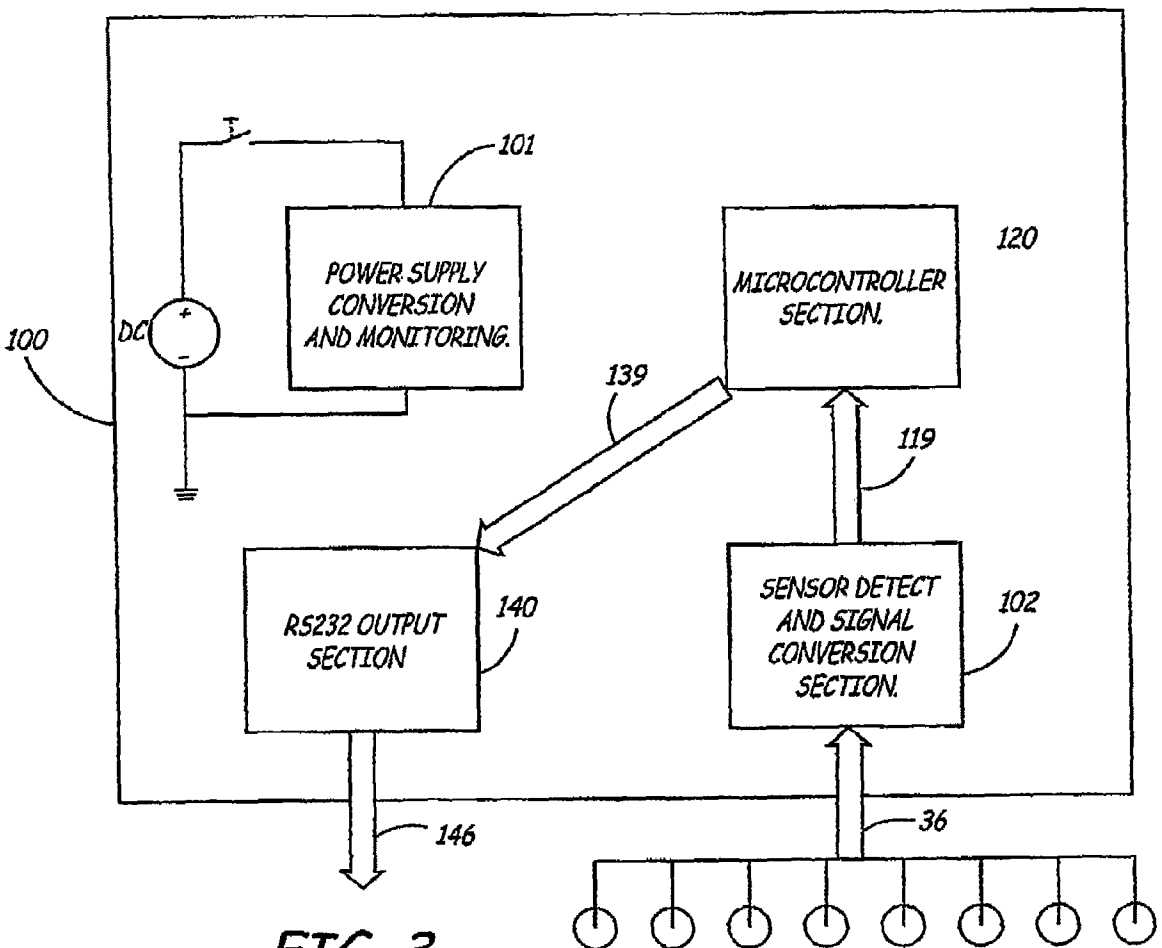
FIG. 3 is a schematic diagram of a voltage controller, according to one embodiment of the present invention.

FIG. 3 depicts the structure of a voltage converter 100, according to one embodiment of the present invention. The voltage converter 100 has a conversion section 102, a microcontroller section 120, a RS232 output 140, and a power supply 101. In operation, the conversion section 102 receives the actuator output signal 36 from a user console 20. According to one embodiment, the conversion section 102 recognizes voltage change from the actuator 30. The microcontroller section 120 polls for any change in voltage in the conversion section 102. Upon a recognized voltage change, the microcontroller section 120 sends an output signal to the RS232 output 140. According to one embodiment, the output signal is a byte representing an actuator identifier and state of the actuator. According to one embodiment, the state of the actuator information includes whether the actuator is on or off. The RS232 output 140 transmits the output signal to the processing computer 150 via 146.

Figure 4:
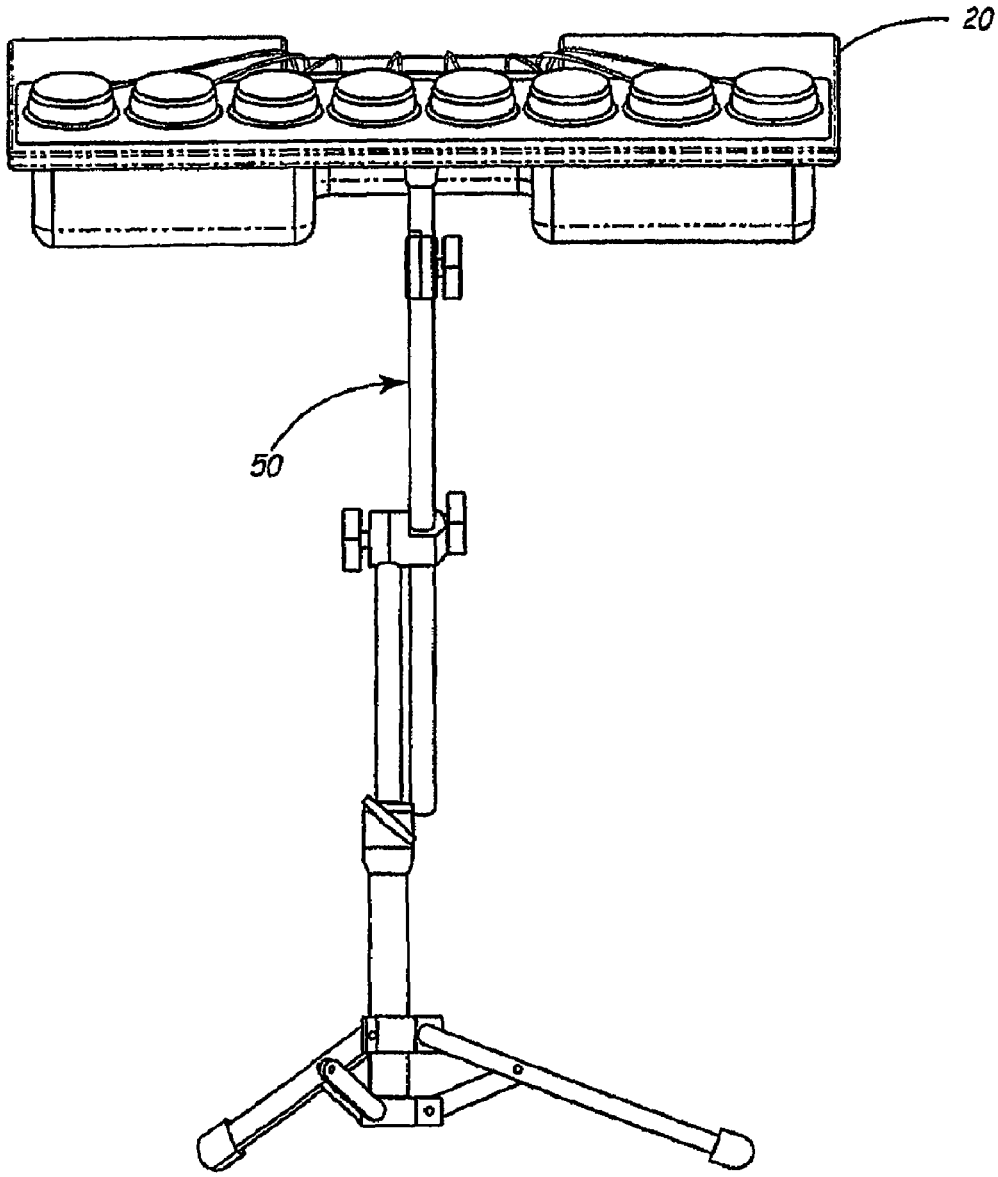
FIG. 4 is a perspective view of a user console and an optional support means, according to one embodiment of the present invention.

FIG. 4 depicts a perspective view of another embodiment of the present invention. Referring to FIG. 4, the present invention in one embodiment includes a user console 20, mounted on an adjustable support 50. In this embodiment, the user may adjust the height of the user interface table by raising or lowering the support. Alternatively, the music apparatus may utilize any other known support configuration.

Figure 5:
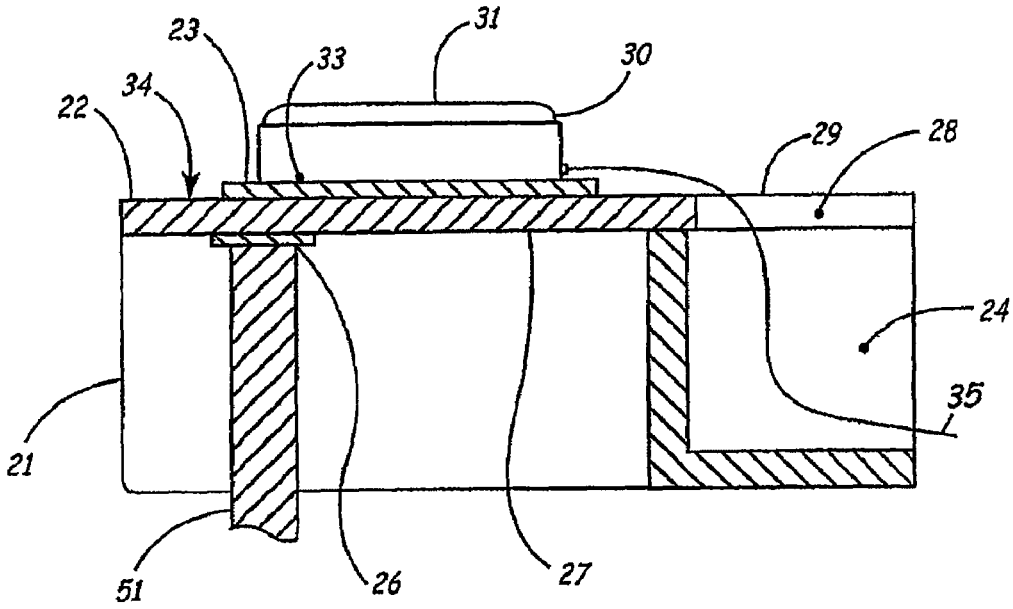
FIG. 5 is a cross-section view of a user interface board according to one embodiment of the present invention.

FIG. 5 shows a cross-section of a user console 20 according to one embodiment of the present invention. The console 20 has a console bottom portion 21 sized to store a plurality of actuators. In one embodiment, a console top portion 22 with cutout 28 is attached to the user console bottom portion 21. Cutout 28 provides access to the interior 24 of the user console 20 through an opening 29 in the user console top portion 22. At least one actuator 30 is attached to the user console top surface 34 by an attachment means 23 that holds the actuator 30 in place while the apparatus is played but allows the musician to remove or relocate the actuator 30 to different positions along the user console top surface 34 and thus accommodate musicians with varying physical and cognitive capabilities. In one embodiment, attachment means 23 may be a commercially-available hook-and-loop fastening system, for example Velcro®. In other embodiments, other attachment means 23 may be used, for example, magnetic strips. An actuator cable 35 is routed into the interior 24 of the user console 20 through the opening 29. Alternatively, a plurality of actuators 30 can be used, and unused actuators can be stored in the user console interior 24 to avoid cluttering the user console top surface 34.

According to one embodiment in which the user console top portion 22 is rigidly attached to the user interface table bottom portion 21, the user console 20 is attached to an upper support member 51 at the table support connection 26 located on the bottom surface 27 of the user console top portion 22.

Although the present invention has been described with reference to preferred embodiments, persons skilled in the art will recognize that changes may be made in form and detail without departing from the spirit and scope of the invention.

I claim:

1. An interactive music apparatus comprising:

a remote wireless device having a touch-sensitive LCD screen, a processor, and software;

a processing host computer;

a transmit/receive device enabling wireless transmission between the remote wireless device and the processing host computer; and a speaker and a second output component, each configured to receive an output signal from the processing host computer and emit an output based on the output signal; and wherein the remote wireless device is configured to receive data from the processing host computer comprising LCD x-y coordinate location information defining an area of the LCD screen for providing a cue or series of cues related to a musical performance, and the remote wireless device is further configured to transmit data comprising LCD x-y coordinate location identification information when a user of the remote wireless device contacts the area defined by the x-y coordinate location information in response to the cue or series of cues; and wherein the processing host computer is configured to receive the data transmitted from the remote wireless device, convert the data into a first output signal and a second output signal, and transmit the first output signal to the speaker and the second output signal to the second output component.

2. The apparatus of claim 1 wherein the output of the speaker is a sound based on the first output signal and the output of the second output component is an action based on the second output signal and the sound and the action are interactive.

3. The apparatus of claim 2 wherein the second output component comprises a web browser and a display monitor and the action comprises launching the web browser and displaying the browser on the display monitor.

4. The apparatus of claim 3 wherein the action further comprises displaying an image on the browser.

5. The apparatus of claim 3 wherein the action further comprises displaying sheet music on the browser.

6. The apparatus of claim 3 wherein the action further comprises displaying text on the browser.

7. The apparatus of claim 2 wherein the second output component comprises a display monitor and the action further comprises displaying a keyboard on the display monitor.

8. The apparatus of claim 2 wherein the second output component comprises a display monitor and the action further comprises displaying a music staff on the display monitor.

9. The apparatus of claim 2 wherein the second output component comprises a lighting controller and at least one light and the action comprises displaying light at the at least one light.

10. The apparatus of claim 1 further comprising a MIDI sound card operably coupled to the processing host computer, the MIDI sound card configured to receive the first output signal.

11. The apparatus of claim 10 further comprising a MIDI sound module operably coupled to the MIDI sound card, the MIDI sound module configured to receive the first output signal from the sound card, process the first output signal, and transmit the output signal to the processing host computer.

12. A method of music performance and composition comprising:

establishing a connection with one or more remote wireless devices, each wireless device controlled by a musical performer;

assessing at least one of the cognitive or physical abilities of each user of the one or more remote wireless devices;

assigning at least a portion of a music performance to each of the one or more remote wireless devices based on the respective performer's cognitive or physical abilities;

transmitting a cue or series of cues to the one or more remote wireless devices, wherein the cue or series of cues transmitted to each remove wireless device is related to the respective portion of a music performance assiged to the remote wireless device, the cue or series of cues based on the respective performer's cognitive or physical abilities;

receiving transmission of a remote wireless device event, wherein the remove wireless device event represents a response to the cue or series of cues;

converting the device event at a processing computer into an output signal;

emitting sound at a speaker based on the output signal.

13. The method of claim 12 further comprising filtering, correcting, assisting, and quantizing a remote wireless device event to aid the performer.

14. An interactive music apparatus comprising:

a remote wireless device having a touch-sensitive LCD screen, a processor, and software;

a processing host computer;

a transmit/receive device enabling wireless transmission between the remote wireless device and the processing host computer; and a speaker and a second output component, each configured to receive an output signal from the processing host computer and emit an output based on the output signal;

wherein the remote wireless device is configured to receive and transmit data related to at least a portion of a musical performance; and wherein the processing host computer is configured to assess at least one of the cognitive or physical abilities of the user of the remote wireless device and assign at least a portion of a music performance to the remote wireless device based on the user's cognitive or physical abilities and further configured to receive data from the remote wireless device, convert the data into a first output signal and a second output signal, and transmit the first output signal to the speaker and the second output signal to the second output component.

15. The method of claim 12 further comprising converting the device event at a processing computer into a second output signal and performing an action at an output component based on the second output signal.

16. The method of claim 15 wherein performing an action at an output component comprises launching a web browser on a display monitor.

17. The method of claim 15 wherein performing an action at an output component comprises displaying an image at a display monitor.

18. The method of claim 15 wherein performing an action at an output component comprises launching a web browser and displaying an image at a display monitor.

19. The method of claim 15 wherein performing an action at an output component comprises displaying lights at an at least one light with a lighting controller.

* * * * *

UNITED STATES PATENT AND TRADEMARK OFFICE

CERTIFICATE OF CORRECTION

PATENT NO. : 7,723,603 B2
APPLICATION NO. : 11/554388
DATED : May 25, 2010
INVENTOR(S) : Daniel W. Moffatt It is certified that error appears in the above-identified patent and that said Letters Patent is hereby corrected as shown below:

CLAIMS

| Column | Line | PTO | Should Read |
|---|---|---|---|
| 10 | 43-44 | "output signal; and" | -- output signal -- |
| 11 | 41 | "to each remove wireless device" | -- to each remote wireless device -- |
| 11 | 43 | "assiged to the remote" | -- assigned to the remote -- |
| 11 | 47 | "wherein the remove wireless device" | -- wherein the remote wireless device -- |

Signed and Sealed this

Sixteenth Day of November, 2010

David J. Kappos

David J. Kappos
*Director of the United States Patent and Trademark Office*